United States Patent [19]

Guthrie

[11] 4,422,787

[45] Dec. 27, 1983

[54] TEAR BAR FOR A PRINTER

[76] Inventor: George L. Guthrie, 2938 E. 62nd St., Indianapolis, Ind. 46220

[21] Appl. No.: 376,719

[22] Filed: May 10, 1982

[51] Int. Cl.[3] ..... B41J 15/00

[52] U.S. Cl. ..... 400/621; 225/89

[58] Field of Search ..... 400/621, 690.1, 621.1, 400/621.2; 225/43, 89

[56] References Cited

U.S. PATENT DOCUMENTS 1,274,540 8/1918 Hall ..... 400/621 X 2,616,365 11/1952 Hicks et al. ..... 400/621 X 3,212,617 10/1965 Sugiyama ..... 400/621

3,513,938 5/1970 Buehner ..... 400/690.1 X

*Primary Examiner*—Edgar S. Burr

*Assistant Examiner*—David A. Wiecking

*Attorney, Agent, or Firm*—Barnes & Thornburg

[57] ABSTRACT

A tear bar for a printer includes a mechanism by which the tear bar is mountable on the paper bail support of the printer. The mounting is pivotal, permitting the tear bar to be moved selectively between use and non-use orientations. The tear bar construction is particularly useful with printers of the general configuration of the International Business Machines Model TR3287 system printer.

4 Claims, 4 Drawing Figures

TEAR BAR FOR A PRINTER

This invention relates to mechanisms which serve as adjuncts to printers of the type generally used in the data processing industry, and particularly to a type of tear bar for use on a printer. This tear bar finds notable application to printers which print upon continuous paper, either roll paper or flat-fold sheets. The illustrated tear bar is particularly useful with the International Business Machines Corporation Type 3287 printer.

Continuous-feed printers, such as those which use paper from a roll or from flat-fold continuous sheet, are widely used in the data processing field in such industries as banking, insurance, education, and the like. Devices for handling the problem of severing paper upon which printing has been done from a continuous feed roll or flat-fold stock is evident. In the flat-fold stock situation, without a tear bar, a printer operator must resort to indexing or "form-feeding" the printer until a perforation on the flat-fold paper has been advanced above the paper feed mechanism (illustratively a tractor-feed mechanism with a pinwheel having pins which engage in perforations which extend along one or both sides of the paper). After such indexing or form-feeding, the paper upon which printing has been done can be torn from the stock in the printer. This procedure can result in a considerable waste of paper and is time-consuming for the operator of the printer. Printer users are generally critical of this paper waste and the inconvenience of having to index or feed paper until a perforation is reached, and have resorted to scissors, knives, razor blades, and a variety of homemade devices to separate printed matter from the paper stock in the printer.

According to the invention, a printer includes a hood covering the printer mechanism. The hood defines an opening through which paper fed through the printer exits. A tear bar is disposed to extend generally across the opening and includes a tearing edge adjacent the surface of the paper as the paper is fed through the opening, the tearing edge extending generally across the opening and beyond the edges of the paper fed therethrough. The tear bar further includes means for selectively receiving a supporting bar, the receiving means being secured to the tearing edge such that receiving the supporting bar in the selective receiving means mounts the tear bar from the supporting bar for movement between use and non-use positions. The tear bar in its use position presents the tearing edge in operative position to permit a user to separate paper from a supply of paper stock as the paper exits from the printer.

According to an illustrative embodiment, the selective receiving means includes a pair of ears on the tear bar positioned beyond the edges of the paper fed therethrough. Illustratively, the ears are constructed from LEXAN® polycarbonate or LUCITE® polymethylmethacrylate. Each ear defines an opening for receiving the supporting bar to mount the tear bar from the supporting bar.

Additionally, according to an illustrative embodiment, the tearing edge comprises a bevelled edge of a sheet of plastic stock, which illustratively may be LUCITE® polymethylmethacrylate.

An illustrative printer includes a supporting bar which is provided with stops beyond which the ears of the tear bar cannot be advanced to permit sliding engagement of the ears and the supporting bar. In this situation, one of the ears illustratively includes means defining a groove between the perimeter of the ear and the means defining the opening in the said one of the ears. The groove provides additional clearance for the entry of the supporting bar into the opening associated with the groove.

The invention may best be understood by referring to the following description and accompanying drawings which illustrate the invention. In the drawings.

Figure 1:
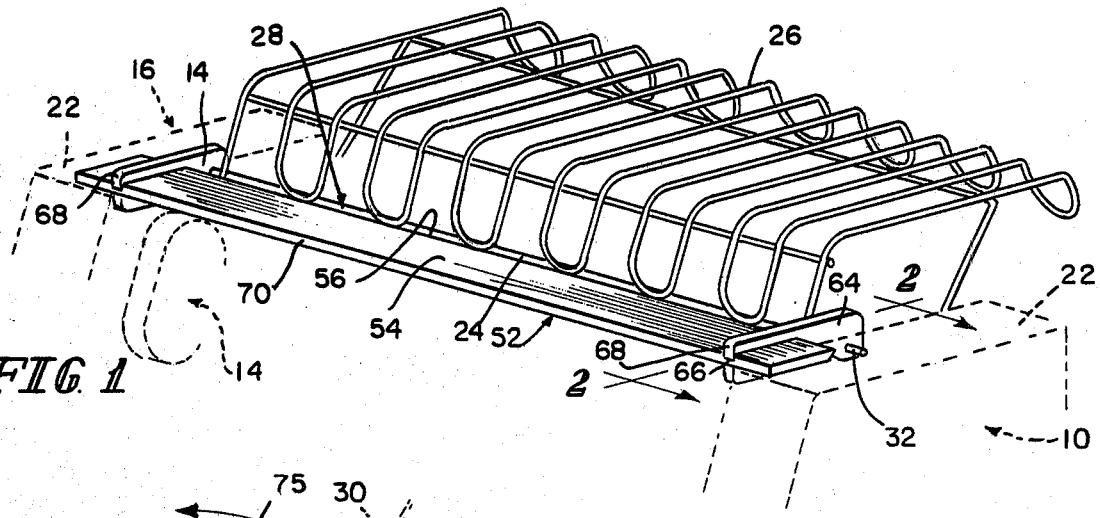
FIG. 1 is a perspective view illustrating the front, top, and right-hand end of the tear bar mounted on the paper bail of a printer, upper portions of the printer hood or cover being illustrated in broken lines.
Figure 2:
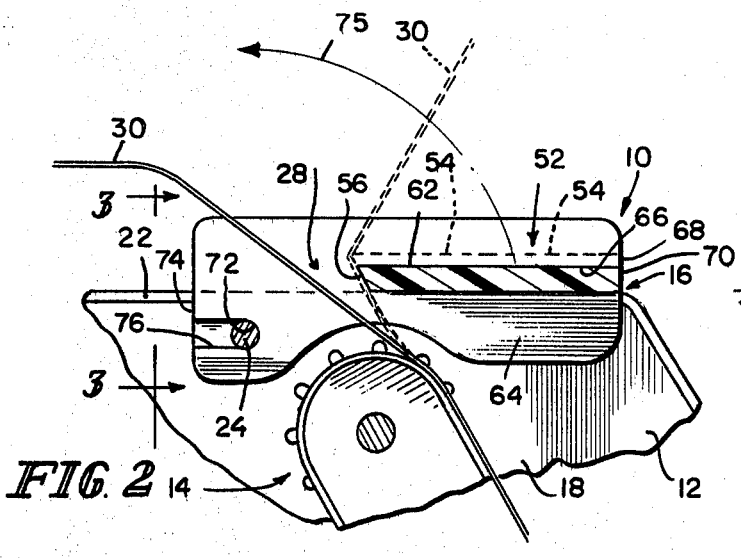
FIG. 2 is a fragmentary sectional view, taken generally along section lines 2—2 of FIG. 1.
Figure 4:
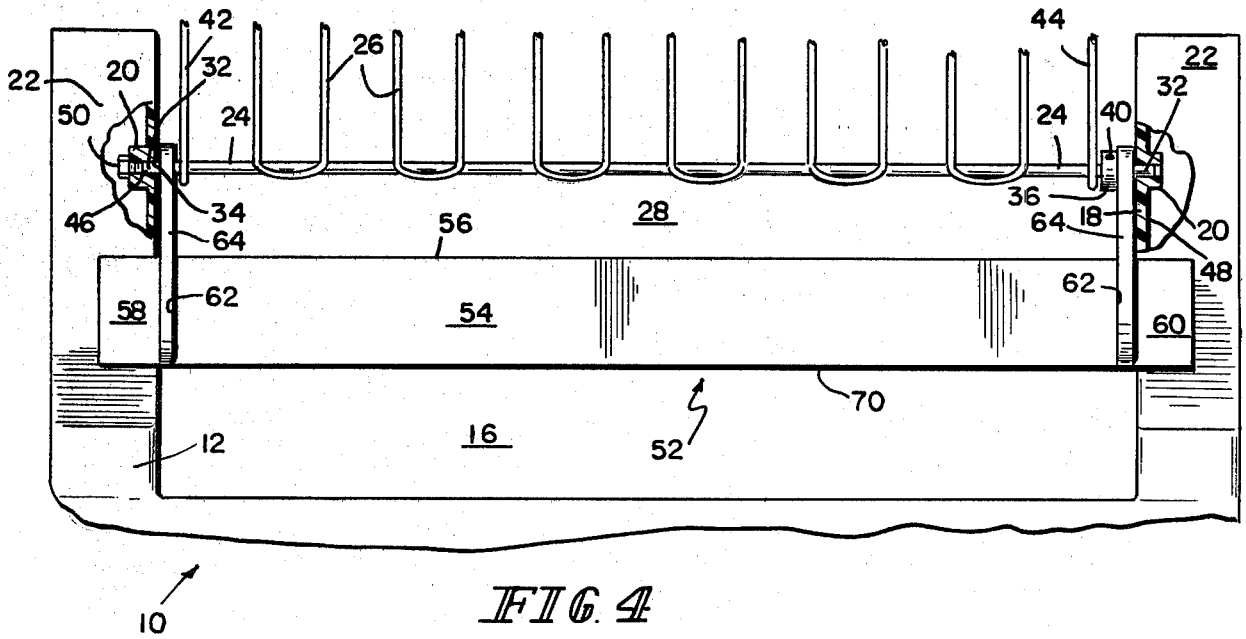
FIG. 4 is a partly fragmentary top plan view of the mechanism illustrated in FIG. 1.

Turning now to FIGS. 1 and 4, a printer such as the IBM Model TR3287 system printer 10 is provided with a cover or hood 12 for protecting the printer mechanism. As best illustrated in FIGS. 1 and 2, the tractor feed mechanism 14 for the printer 10 is disposed directly beneath the hood 12 near the top 16 thereof.

The covering or hood 12 further includes end plates 18, illustratively provided with bosses 20 projecting outwardly therefrom in opposite directions. End covers 22 are fitted over the plates 18 to enclose and protect the ends of a paper bail mounting bar 24 to which is attached, illustratively by welding, a paper bail or paper support 26. The paper bail mounting bar 24 extends generally across the opening 28 in the top of the printer 10 hood 12 through which sheet paper stock 30 exits from the printer 10. This orientation of the bar 24 supports the bail 26 in a position to receive and support the paper, or guide it downwardly and rearwardly behind the printer 10, illustratively to a storage receptacle (not shown).

The ends 32 of the paper bail 26 mount in respective openings or passageways 34 which extend generally through the centers of respective bosses 20 on the end plates 18. A typical printer 10, such as the IBM Model TR3287 system printer, includes a paper bail mounting bar 24 which is provided with a spacer collar or ring 36 mounted and secured to the paper bail mounting bar 24 by a Bristol screw 40. In the typical printer, the ends 42, 44 of the paper bail wire are positioned close to the respective ends 46, 48 of the paper bail mounting bar 24, but not close enough to prevent accidental dislodging of the ends 46, 48 of bar 24 from the passageways 34, should the bail 26 inadvertently be shifted axially either left or right (as illustrated in FIG. 4). To avoid such accidental dislodgment, at one end, 46, of the bar 24, a slotted hex-headed screw 50 is threaded into the passageway or opening 34 through the left-hand end boss 20. This prevents inadvertent lateral shifting of the bar 24 leftward. To prevent lateral shifting of the bar 24 rightward so far that end 46 of the bar 24 would be dislodged from its opening 34, spacer 36 is ordinarily positioned near the right-hand end plate 18 to reduce to a minimum the free axial play of the bar 24 in openings 34.

The tear bar 52 of the present invention is configured to be mounted on the ends 46, 48 of the paper bail mounting bar 24. The tear bar 52 includes a generally flat, rectangular sheet 54 of stock constructed illustratively from LUCITE® polymethylmethacrylate. One edge 56 of the tear bar 52, hereinafter referred to as the tearing edge, is ground or otherwise formed at a bevel of approximately 60° to horizontal upwardly and rearwardly of the printer, as best illustrated in FIG. 2. Inwardly from the ends 58, 60 of the sheet 54, grooves 62 of rectangular cross-section configuration are machined or otherwise formed in the sheet 54. The grooves 62 are spaced apart such that their outer surfaces are separated by a distance substantially equal to the distance between the inner surfaces of end plates 18. This is done so that the printer 10 with the tear bar 52 mounted on it can handle paper of substantially the same maximum width as the printer 10 without the tear bar 52 on it.

A pair of mounting ears 64, configured as best illustrated in FIGS. 1, 2, and 4, are slotted (66) inwardly from their front edges 68 to a sufficient depth to place the front (non-tearing) edge 70 of the tear bar 52 substantially flush with the front edges 68 of the mounting ears 64. Ears 64 illustratively are formed from plastic stock. The depths of the slots 66 are equal to the thickness of the generally flat sheet 54 in the regions of grooves 62. In the assembly of the tear bar itself, the ears 64 slide into the grooves 62 in the regions of slots 66. Any suitable glue or other attachment mechanism can be used to secure the ears 64 to the generally flat sheet 54 to form the completed tear bar 52. It may be that, under certain circumstances, the frictional fit of the bar 52 in the grooves 62 is sufficienty close that no other attachment mechanism is necessary to maintain the tear bar 52 in assembled orientation.

To ensure that the tearing edge 56 is presented adjacent the opening 28 and in a rearwardly facing orientation, each mounting ear 64 is provided with an opening 72 (FIG. 2) near its rearwardly facing edge 74. Openings 72 have diameters and cross-sectional configurations which conform generally to the diameter and cross-sectional configuration of the paper bail mounting bar 24, but permit pivotal movement of the tear bar 52, as illustrated by arrow 75 in FIG. 2, about the paper bail mounting bar 24.

To mount the tear bar 52 from the paper bail mounting bar 24, the paper bail 26 is removed from the end plates 18 of the printer 10 by loosening the Bristol screw 40 and slotted hex-headed screw 50. This permits axial shifting of the paper bail mounting bar 24 first to clear the end plate 18 at one end of the printer, and then to clear the end plate 18 at the other end of the printer. Of course, typically the end covers 22 are removable from the printer 10 hood 12 to facilitate this removal. Then, the paper bail mounting bar 24 is worked into the openings 72 in the mounting ears 64, first by working one end 46 of bar 24 into its respective opening 72 and then by shifting the end 46 axially in opening 72 sufficiently far (typically all the way to the stop provided by paper bail wire end 42) to work the other ear 64 onto the other end 48 of paper bail mounting bar 24.

Figure 3:
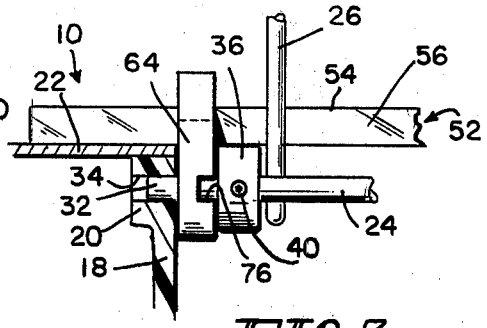
FIG. 3 is a fragmentary sectional view, taken generally along section lines 3—3 of FIG. 2.

In certain printers, there may not be quite enough clearance to work the second mounting ear 64 onto its respective end 48 of the paper bail mounting bar 24. It is therefore desirable in many cases to provide an additional clearance mechanism to assist in this mounting operation. With particular reference to FIGS. 2 and 3, that mechanism is illustrated to include a groove 76 which extends straight horizontally and rearwardly from the opening 72 in the right-hand end mounting ear 64 toward the rearward edge 74 of the right-hand end mounting ear 64, the groove 76 opening into the rearward edge 74. The depth of this groove 76 is chosen to provide clearance to facilitate mounting of the tear bar 52 on the paper bail mounting bar 24. After the tear bar 52 is mounted on the paper bail mounting bar 24, the tear bar 52 can be generally centered on the paper bail mounting bar 24, and the spacer 36 can be positioned and its Bristol screw 40 tightened to minimize lateral shifting of the paper bail 26.

What is claimed is:

1. A tear bar for a printer including a hood covering the printer mechanism, the hood defining an opening through which paper fed through the printer exits, and a bar disposed to extend generally across the opening, the tear bar including a tearing edge adjacent the surface of the paper as the paper is fed through the opening, the tearing edge extending generally across the opening and beyond the edges of the paper fed through the opening, a pair of ears for selectively receiving the first-mentioned bar, the pair of ears provided on the tear bar and positioned beyond the edges of the paper fed therebetween, each of the ears defining an opening for receiving the first-mentioned bar to mount the tear bar from the first-mentioned bar, the ears being formed from plastic stock, the ears being secured to the tearing edge such that receiving the first-mentioned bar through the ear's openings mounts the tear bar from the first-mentioned bar for movement between use and non-use positions, the tear bar in its use position presenting the tearing edge in operative position to permit a user to tear the paper as it exits from the printer, the tearing edge comprising a bevelled edge of a sheet of plastic stock, and the first-mentioned bar including stops beyond which the ears cannot be advanced to permit sliding engagement of the ears, one of the ears including means defining a groove between its perimeter and the means defining an opening in said one of the ears, the groove providing additional clearance for the entry of the first-mentioned bar into the opening associated with the groove.

2. The tear bar of claim 1 wherein the first-mentioned bar is the printer's paper bail mounting bar.

3. A tear bar for a printer including a hood covering the printer mechanism, the hood defining an opening through which paper fed through the printer exits, and support means comprising a paper bail mounting bar disposed generally at the ends of the opening adjacent the paper edges, the printer including a paper bail, the tear bar including a tearing edge adjacent the surface of the paper as the paper is fed through the opening, the tearing edge extending generally across the opening and beyond the edges of the paper fed therethrough, the tear bar further including a pair of ears on the tear bar for selectively engaging the support means, the ears being secured to the tearing edge such that engaging the support means with the ears mounts the tear bar from the support means for movement between use and non-use positions, the ears positioned on the tear bar beyond the edges of the paper fed therebetween, each of the ears defining an opening for receiving a respective end of the paper bail mounting bar to mount the tear bar from the paper bail mounting bar, the paper bail mounting bar including stops formed by the connection of the paper bail to the paper bail mounting bar, the ears being incapable of being advanced beyond the stops to permit sliding engagement of the ears on the paper bail mounting bar, and one of the ears including means defining a groove between its perimeter and the means defining an opening in said one of the ears, the groove providing additional clearance for the entry of the paper bail mounting bar into the opening associated with the groove, the tear bar in its use position presenting the tearing edge in operative position to permit a user to tear the paper as it exits from the printer.

4. A tear bar for a printer including a hood covering the printer mechanism, the hood defining an opening through which paper fed through the printer exits, and support means comprising a paper bail mounting bar disposed generally at the ends of the opening adjacent the paper edges, the printer including a paper bail, the tear bar including a tearing edge adjacent the surface of the paper as the paper is fed through the opening, the tearing edge extending generally across the opening and beyond the edges of the paper fed through the opening, the tear bar further including means for selectively engaging the support means, the engaging means being secured to the tearing edge such that engaging the support means with the engaging means mounts the tear bar from the support means for movement between use and non-use portions, the tear bar in its use position presenting the tearing edge in operative position to permit a user to tear the paper as it exits from the printer, the paper bail mounting bar including stops formed by the connection of the paper bail to the paper bail mounting bar, the engaging means being incapable of being advanced beyond the stops to permit sliding engagement of the engaging means on the paper bail support bar, and one of the engaging means including means defining a groove between its perimeter and the means defining an opening in said one of the engaging means, the groove providing additional clearance for the entry of the paper bail support bar into the opening associated with the groove.

* * * * *